US007472446B2

(12) United States Patent
Parker

(10) Patent No.: US 7,472,446 B2
(45) **Date of Patent: *Jan. 6, 2009**

(54) SIDE RAIL PAD SYSTEM FOR PATIENT SUPPORT APPARATUS

(75) Inventor: Jeffrey Scott Parker, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/800,867

(22) Filed: May 8, 2007

(65) Prior Publication Data

US 2007/0209117 A1 Sep. 13, 2007

Related U.S. Application Data

(63) Continuation of application No. 11/051,658, filed on Feb. 5, 2005, now Pat. No. 7,231,678.

(60) Provisional application No. 60/542,385, filed on Feb. 6, 2004.

(51) Int. Cl.
*A47C 31/00* (2006.01)

(52) U.S. Cl. ..... 5/663; 5/658

(58) Field of Classification Search ..... 5/424–425, 5/663, 658

See application file for complete search history.

(56) References Cited

U.S. PATENT DOCUMENTS 6,038,721 A 3/2000 Gordon
6,615,426 B1 * 9/2003 Risk, Jr. ..... 5/425
7,231,678 B2 6/2007 Parker

OTHER PUBLICATIONS

FDA, Center for Devices and Radiological Health, "Hospital Bed System Dimensional and Assessment Guidance to Reduce Entrapment," Mar. 10, 2006, p. 12 (www.fda.gov/cdrh/beds/guidance/1537.html).

* cited by examiner

*Primary Examiner*—Patricia Engle
*Assistant Examiner*—Fredrick Conley
(74) *Attorney, Agent, or Firm*—Fulbright & Jaworski L.L.P.

(57) ABSTRACT

A side rail pad system that provides modifications and components operable in association with hospital beds and the like that are designed to articulate. The system improves upon the structural shape of the side rails used in association with the articulating bed frames and provides an arrangement of side rail pads that are positioned between the side rails and the existing mattress platform. The side rail pads are positioned on the bed frame with flexible hinges in a manner that allows their alternate movement between a placement that fills the space between the side rails and the mattress when the side rails are in a raised position, and a placement away from the side of the mattress when the side rails are rotated into a lowered position.

15 Claims, 3 Drawing Sheets

SIDE RAIL PAD SYSTEM FOR PATIENT SUPPORT APPARATUS

CROSS-REFERENCE TO RELATED APPLICATION

This is a continuing application, under 35 U.S.C. § 120, of U.S. application Ser. No. 11/051,658, filed Feb. 5, 2005 now U.S. Pat. No. 7,231,678, which claims the benefit under 35 U.S.C. § 119(e) of U.S. Provisional Application No. 60/542,385, filed Feb. 6, 2004; the prior applications are herewith incorporated by reference in their entirety.

BACKGROUND OF THE INVENTION

1. Field of the Invention

The present invention relates to side rail systems utilized on patient support platforms and beds. The present invention relates more specifically to a system of partially rigid pads positioned in conjunction with the side rails of patient support platforms, hospital beds, and the like.

2. Description of the Related Art

The basic patient support system utilized in most hospitals and extended care facilities provides a number of essential elements intended to accommodate a variety of patient conditions and situations. The basic support system incorporates a mattress positioned on a platform or other frame, most commonly connected with an underlying base frame mounted on casters for mobility. There is typically a head board and a foot board to enclose the upper and lower end of the mattress platform. There are also typically a number of side rails that may be raised or lowered to alternately enclose the mattress or allow the patient access to or exit from the bed. In addition, most such patient support systems incorporate articulating frames and mattresses that allow an upper (head) section to be raised at an angle with respect to a middle or torso section, and likewise for a lower (foot) section to be lowered at an angle below the middle or torso section. Such articulations facilitate both the comfort of the patient and the ease with which the patient may enter and exit the bed.

The combination of side rails and articulating frames on patient support surfaces has resulted in the development of very specific design features that are incorporated into the side rails to allow their movement into either raised or lowered positions both while the bed is horizontally planar and while the bed is articulated into angled configurations. In most instances the requirements for bed articulation dictate that each side rail be divided into two parts, an upper side rail associated with the head section of the bed and a lower side rail covering the balance of the side of the bed enclosure. Mirror images of these side rails are positioned on an opposite side of the bed, and operate in conjunction with the head board and foot board to fully enclose the patient within the bed or mattress area. The various components of the basic patient support system that serve to enclose the patient within the platform area give rise to new problems associated with the safety and comfort of the patient. Because it is necessary for these various enclosing panels to move and articulate themselves as the bed frame moves and articulates, there are necessarily gaps, openings, and passages between the various panel components, and between the panel components and the mattress itself. Efforts have been made in the past to appropriately fill the gaps and spaces between the various components that make up the patient support system. For the most part these efforts have focused on the addition of loose cushions to block the openings between the various enclosing panels and side rails. Such systems clearly suffer from the inability to maintain a fixed association between the cushions and the patient support platform and to accommodate the articulation of the bed frame.

As discussed in more detail below, various governmental agencies and standards organizations have identified spatial zones of concern that relate to the safety and comfort of the patient positioned on the typical hospital bed utilizing side rails. For those hospital beds and patient support platforms that have an articulating structure, these elements take on added dimensions depending upon the various orientations of the support platform components. The typical articulating patient support platform that utilizes side rails will incorporate split side rails on each side of the bed. A first set of side rails are associated with the upper or head portion of the support platform, and move in conjunction with it as it is raised and lowered. A second set of side rails are typically associated with the lower and/or middle portion of the patient support platform and move in conjunction therewith. A number of existing bed designs include mechanisms that allow the knee area of the platform to articulate. Although the angle that is achieved is generally less than that between the upper (head) section and the middle (torso) section, the rails that are connected to the lower (foot) section do move in conjunction with the lower (foot) section as it is raised and lowered with respect to the middle (torso) section. Each of the side rails also move (typically through an arc of rotation to the side and down) into a lowered and stored position away from the side of the mattress as is well known in the art. Because of the relative movement between the two side rail components that occurs with the above articulations, it is necessary to structure and design the components to both accommodate the articulating motion, the ability to rotate the side rails out of the way, and the continued purpose of having side rails, namely the appropriate enclosure of the patient support area.

While efforts have been made in the past to improve safety and comfort for the patient, such efforts often fail to allow the continued versatility associated with existing articulating bed frames. Such safety and comfort panels and pads very often must be removed before a bed platform can be articulated into an elevated or lowered position. It would be desirable to have a system for side rail pad components that continued to allow full movement of the bed frame components at the same time it provided for improved safety and comfort to the patient. It would further be desirable that such components could be moved from positions directly in contact with the sides of the patient support mattress to positions completely apart from the patient support mattress, such movement occurring in conjunction with the same or similar movement of the side rails themselves.

SUMMARY OF THE INVENTION

It is therefore an object of the present invention to provide a side rail pad system for use in conjunction with a patient support apparatus, that serves to improve the safety and comfort of the patient, especially in a support platform that incorporates articulating elements. The present invention is directed towards a system that improves the safety and comfort of the patient without sacrificing versatility and articulation movement in the patient support platform. Modifications to existing side rail designs and structures may be combined with the additional side rail pad systems of the present invention to provide overall improvement to the hospital bed or patient support platform. The goal is to achieve these improvements without significantly altering the structural characteristics of existing patient support devices by allowing the retrofit of existing devices with the components and elements of the present invention.

Efforts are currently underway by governmental agencies and standard setting organizations to define and clarify requirements for patient support systems including the requirements that are directed towards the safety and comfort of the patient with regard to the enclosures that surround the mattress or patient support platform. These efforts have identified a variety of spatial zones within the typical patient support platform or hospital bed that may be of concern from a safety and comfort standpoint. The present invention is directed towards addressing these zones of concern by providing appropriate closures or barriers that are generally identified and agreed upon as necessary for the safety and comfort of the patient.

In fulfillment of these and other objectives, the present invention provides a number of modifications and additional system components that are operable in association with hospital beds and other patient support systems designed to articulate, so as to elevate an upper or head portion of the bed, with respect to a middle or torso portion of the bed, and so as to lower a lower or a foot portion of the bed with respect to the middle portion of the bed. In conjunction with such patient support systems, the present invention improves upon the structural shape and design of the side rails used in association with the articulating bed frames as well as providing a system of side rail pads that are positioned between the existing side rails and the existing mattress structure of such patient support systems.

The structural design improvements to the side rails include modifications to the split rail profiles such that greater congruency between the split rails is maintained throughout the articulating movement of the bed. Additionally, a system of side rail pads are positioned on the bed frame with a number of flexible hinges in a manner that allows their alternate positioning between a placement that fills the space between the side rails and the mattress, and a placement away from the side of the mattress when the side rails of the platform are rotated into a lower or stowed position. When the side rails of the platform are raised, the side rail pads are positioned to facilitate the prevention of the movement of the patient into the space between the side rail and the mattress and to assist in preventing the patient from moving into the area between the split side rails on the typical articulating hospital bed. When the split side rails are lowered, the rail pad system components themselves are allowed to pivot on their flexible hinges connected to the bed frame, towards an out-of-the-way position adjacent the lowered side rails, thus allowing patient entrance to or exit from the bed surface.

The semi-rigid pad components of the side rail pad system of the present invention are composed of layered, rigid or semi-rigid plate elements and foam cushion elements so as to provide a firm but comfortable barrier to the intrusion of the patient into the zones of concern. A rigid or semi-rigid plate is surrounded on either side by foam pads with the entire layered assembly being surrounded by a fabric envelope. Access to the inside of the fabric envelope may be provided to change out or alter the rigid plate and the foam pads. A flexible hinge, such as a length of nylon webbing, may be attached at a number of points along an edge of the side rail pad components to provide points of attachment to the bed frame. Structural features in the profiles of the side rail pad components permit the continued articulation of the bed frame, despite the presence of the pad component in association with the bed frame elements.

DETAILED DESCRIPTION OF THE PREFERRED EMBODIMENTS

Figure 1:
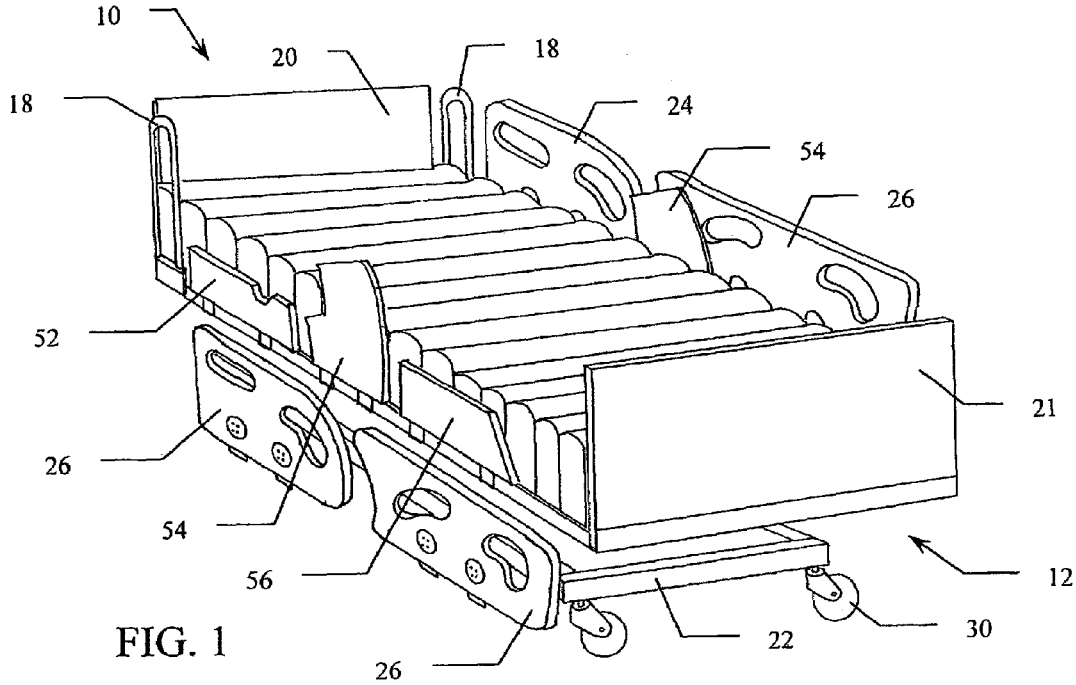
FIG. 1 is a perspective view of a patient support system incorporating the side rail pad system of the present invention.

Reference is made first to FIG. 1 for a general description of a patient support system implementing the side rail pad system of the present invention. In FIG. 1, bed 10 is shown in a perspective view with one set of side rails elevated and a second set of side rails lowered as may typically be the case in a hospital setting. Bed 10 is comprised of frame 12 positioned on, and supported by base 22. Mattress 16 is positioned on top of frame 12 and may be any of a number of different mattress structures including air inflation mattress systems. Base 22 is made mobile by the provision of a plurality of casters 30 positioned thereon.

Enclosing the surface area of mattress 16, are head board 20 and foot board 21 at the upper and lower extremes of the mattress surface area. On the sides of mattress 16 are head space bars 18, upper side rails 24, and lower side rails 26. The upper and lower side rails 24 and 26 positioned on either side of mattress 16 are mirror images of each other and operate in a manner generally well-known in the art.

The components of the present invention include upper side rail pads 52, middle side rails pads 54, and lower side rail pads 56. In FIG. 1, both sets of three component side rail pads are shown implemented on bed 10. For clarity, upper and lower side rails 24 and 26 are shown lowered on one side of the bed and elevated on the opposite side of the bed. Again for clarity, side rail pads 52, 54 and 56 on the side of bed 10 with the lowered side rails, are shown in a raised position to indicate the manner in which they would normally be held when the side rails are elevated. The elevated side rails on the opposite side of the bed conceal the raised side rail pads, with exception of an upper extremity of middle side rail pad 54 thereon.

Figure 2:
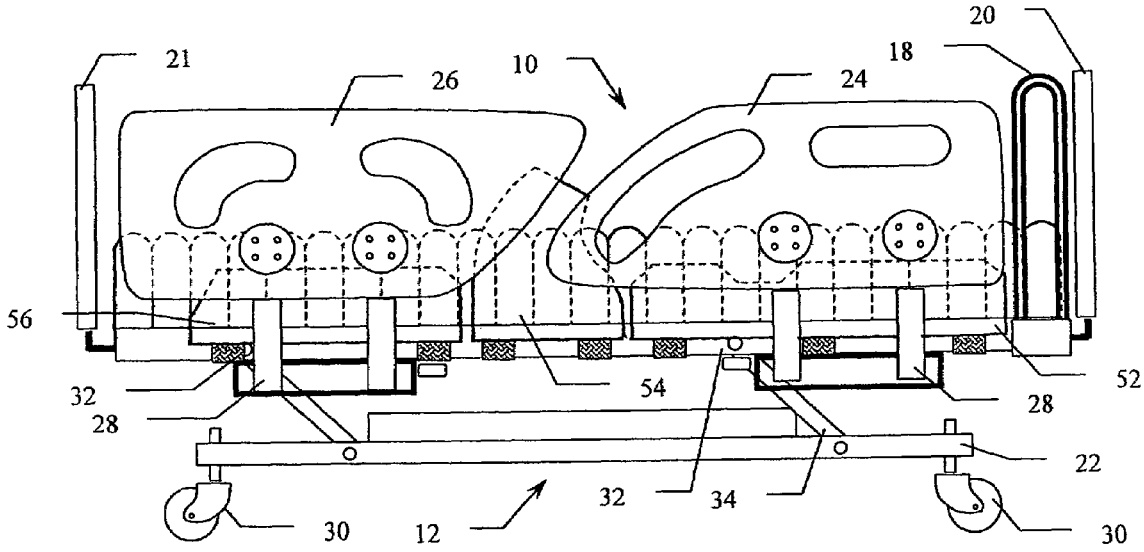
FIG. 2 is a side view showing implementation of the side rail pad system of the present invention on a typical articulating hospital bed.

Reference is now made to FIG. 2 for a more detailed description of the attachment and function of the side rail pads of the present invention. In FIG. 2, a side view of bed 10, upper side rail 24 and lower side rail 26 of one side of bed 10 are shown in their elevated positions. The movement of these side rails is accomplished in a manner well known in the art, through the use of side rail brackets 28, which serve to rotate the side rail panels to the side and down and below the mattress. Such a lowered and stowed position allows the patient to easily exit or access the bed as necessary.

Also shown in FIG. 2 are the articulation mechanisms associated with bed 10. These include articulation levers 34 positioned between base 22 and frame 12. These levers, again operable as known in the art, serve to manipulate the components of frame 12 into the various configurations described above. Frame 12 itself is segmented and with segments pivoting at articulation points 32. Once again, these articulation points 32 permit an upper (head) section of the bed surface to be elevated with respect to a middle (torso) section of the bed. Likewise, a lower articulation point 32 allows the lowering of a foot portion of the bed below and at an angle to the middle portion of the bed.

As described above, the configuration of upper side rail 24 and lower side rail 26 are determined in part by the need to rotate and lower the side rails out of the way, and the need to articulate the bed with these side rails in both the elevated and lowered positions. The profiles shown in FIG. 2, therefore, accommodate these various manipulations of the patient support surface. As will be anticipated by those skilled in the art, the gaps between the various panels enclosing the surface area of the mattress will alter in shape, and vary in size, depending upon the articulation of the bed frame 12. The design of the present invention, including the shape and size of the upper side rail 24 and lower side rail 26, provide novel efforts to minimize the alteration of these gaps and openings despite the manipulation of the articulating bed components.

Also incorporated in upper side rail 24 and lower side rail 26, are side rail access ports 36. These elongated openings serve to allow access to the patient by caregivers and the like, while still minimizing the risk that the patient might unsafely or uncomfortably encounter such openings. In other words, the access ports provide access without detracting from the function of the side rails to enclose the patient within confines of the bed surface.

Implementation of the system of the present invention involves positioning each of three components (one set of three on each side of the bed) in the manner shown in FIG. 2. Upper side rail pad 52 is positioned, as indicated, in association with upper side rail 24, between upper side rail 24 and mattress 16. Upper side rail pad 52 is attached to frame 12 by a plurality of flexible hinges as described in more detail below.

Middle side rail pad 54 is likewise positioned and secured to frame 12 in a manner that places it in the area between upper side rail 24 and lower side rail 26. Middle side rail pad 54 extends upward above the surface of the mattress to address and partially occlude the space between upper side rail 24 and lower side rail 26; a space that is repeatedly modified in shape and size when the bed is articulated as described above.

Finally, lower side rail pad 56 is positioned as shown in FIG. 2, in association with lower side rail 26, between lower side rail 26 and mattress 16. As with upper side rail pad 52, middle side rail pad 54 and lower side rail pad 56 are attached to and positioned on frame 12 by means of a plurality of flexible hinges as described in more detail below.

Figure 3:
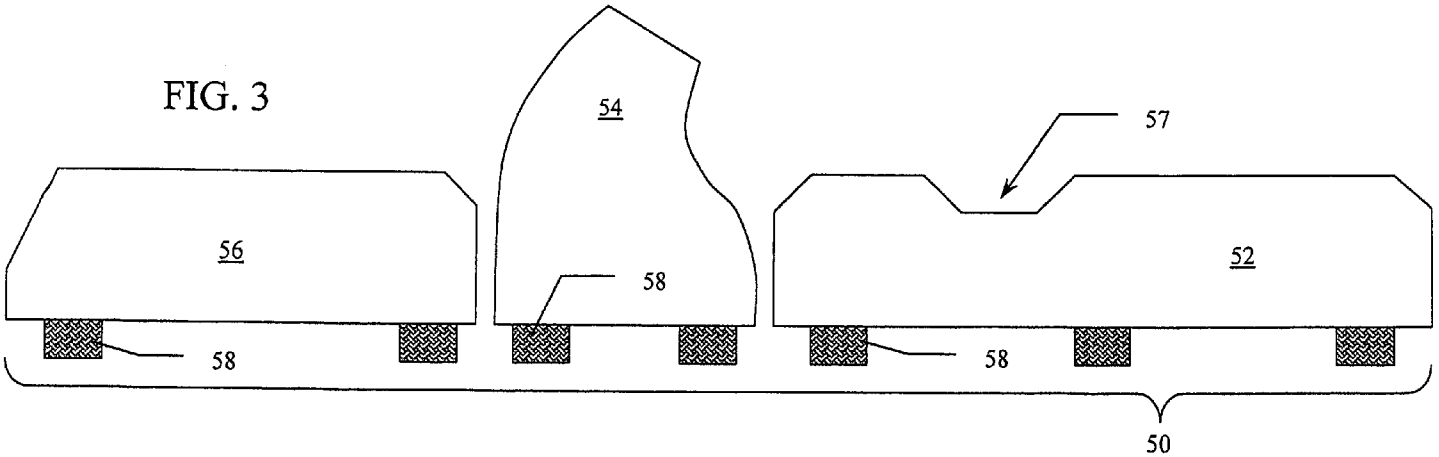
FIG. 3 is a side view of the three fundamental components of the side rail pad system of the present invention.

Reference is now made to FIG. 3 for a detailed description of one complete rail pad set 50 comprising each of the components mentioned above. Rail pad set 50, which is duplicated on either side of the patient support system, is comprised of upper side rail pad 52, middle side rail pad 54, and lower side rail pad 56. As indicated above, each of the side rail pads incorporates a plurality of hinges 58 (shown folded or closed in FIG. 3) that flexibly position and retain the side rail pads to the frame of the patient support system.

In FIG. 3, the shapes and configurations of the side rail pads are shown in greater detail. Upper side rail pad 52 incorporates an articulation point 57 in its profile design. This articulation point 57 aligns with and bends in conjunction with the articulation points described above in FIG. 2 on frame 12 shown therein. For example, in conjunction with upper side rail pad 52, the elevation of the upper (head) portion of the bed frame would cause upper side rail pad 52 to bend and buckle at articulation point 57, shown in detail in FIG. 3. The profile configuration and the internal construction (described in more detail below) of upper side rail pad 52 permit the articulation of the bed frame and the bending of upper side rail pad 52, without detriment to either its structure or function.

Figure 4:
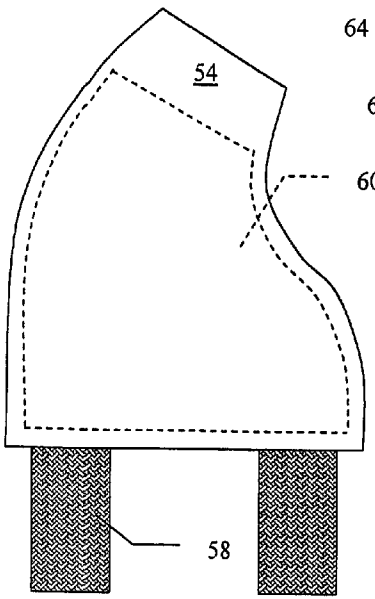
FIG. 4 is a detailed side view of the center panel component of the system of the side rail pad system present invention.

Reference is now made to FIGS. 4, 5, 6, and 7 for further detail on the internal and external construction of the side rail pads described above for the system of the present invention. FIG. 4 shows in detail the structure and shape of middle side rail pad 54. The external shape is consistent with the objective of occluding the changes that occur in the space in between the upper side rail and lower side rail of the typical patient support platform. Of particular note is the elongated portion of the pad that extends above the mattress surface in a manner that deters patient entry into the zone between the upper and lower side rails.

While middle side rail pad 54 is generally of soft, flexible construction (as described in more detail below with FIG. 5) it does incorporate a rigid or semi-rigid shape element positioned internal to the pad to maintain its upright orientation and its general profile configuration. This rigid or semi-rigid insert 60 is shown in dashed line detail in FIG. 4. Also shown in FIG. 4 are flexible hinges 58 shown released from their engagement with the bed frame.

Figure 5:
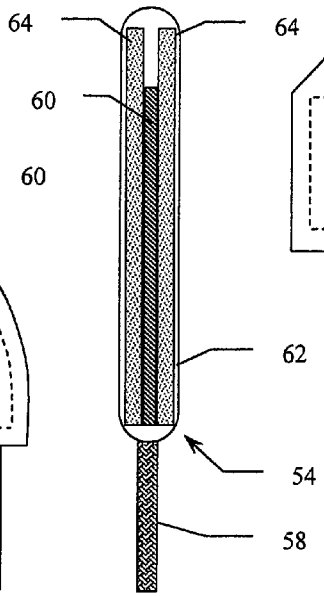
FIG. 5 is a detailed cross-sectional view of the center component shown in FIG. 4.

FIG. 5 shows in cross-sectional detail the typical construction of not only middle side rail pad 54, but also, in a generic manner, upper and lower side rail pads 52 and 56. Rigid or semi-rigid insert 60 is positioned in a center location within the layered construction of the pad. On either side of rigid insert 60, are positioned foam pads 64. Surrounding this three-layer construction is fabric envelope 62 that may be appropriately sewn shut or alternately provided with a reclosable opening such as a zipper closure, hook and loop material closure or envelope fold. Sewn into and positioned on fabric envelope 62 is flexible hinge 58, as indicated above. It should be noted that in each case (upper, middle, and lower side rail pads) the rigid inserts do not extend entirely up to the upper extremity of the side rail pad. This is shown with particular emphasis in FIGS. 4 and 5 wherein rigid insert 60 is smaller in size (in an upward direction) than both the foam pads that surround it and the enclosing fabric envelope. The purpose of this configuration is to provide a soft upper edge to each of the side rail pads.

Figure 6:
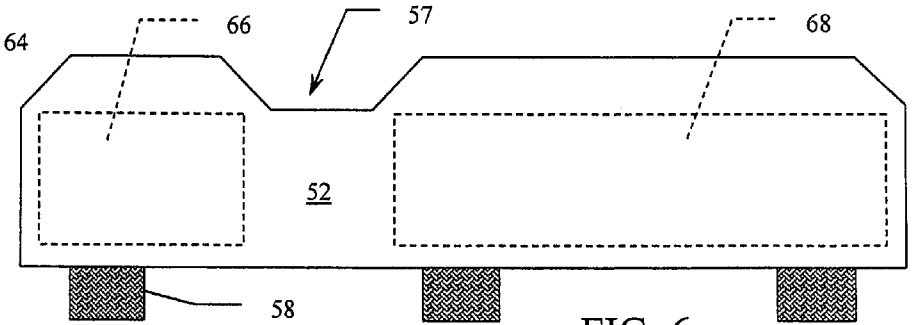
FIG. 6 is a detailed side view of the upper side rail pad of the system of the present invention.

Reference is now made to FIG. 6 for a brief description of the interior details of upper side rail pad 52. It is understood that the internal and external constructions of lower side rail pad 56 are similar to those of upper side rail pad 52. Rigid or semi-rigid insert 68 is a longer, rectangular component that is positioned within the pad in a manner similar to that described in conjunction with FIG. 5. Likewise, rigid or semi-rigid insert 66 is a smaller rectangular insert, again positioned and retained within upper side rail pad 52 in the same manner as that described in FIG. 5. Each of the inserts 60, 66, and 68, may be constructed of any appropriate durable rigid or semi-rigid material that provides adequate stiffness to retain both the shape and upright orientation of the side rail pads. Aluminum plate or phenolic plates may be utilized for the rigid insert materials. Semi-rigid materials may include polymer plastic plates or the like.

Figure 7:
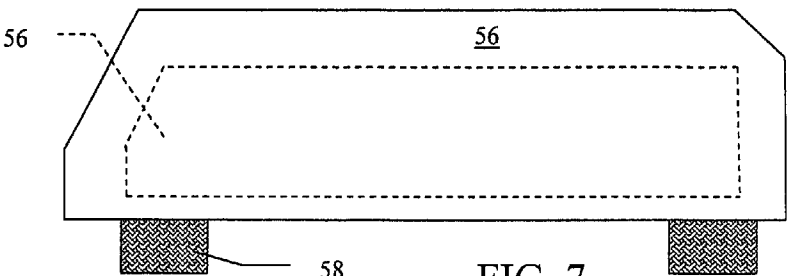
FIG. 7 is a detailed side view of the lower side rail pad of the system of the present invention.

Reference is now made to FIG. 7 for a brief description of the interior details of lower side rail pad 56. Rigid or semi-rigid insert 70 is a trapezoidal component that is positioned within the pad in a manner similar to that described in conjunction with middle side rail pad 54 shown in cross-section in FIG. 5. The angled end of insert 70 (and thus of the overall pad), accommodates the articulation of frame 12 between its lower (foot) section and the middle (torso) section.

Figure 8:
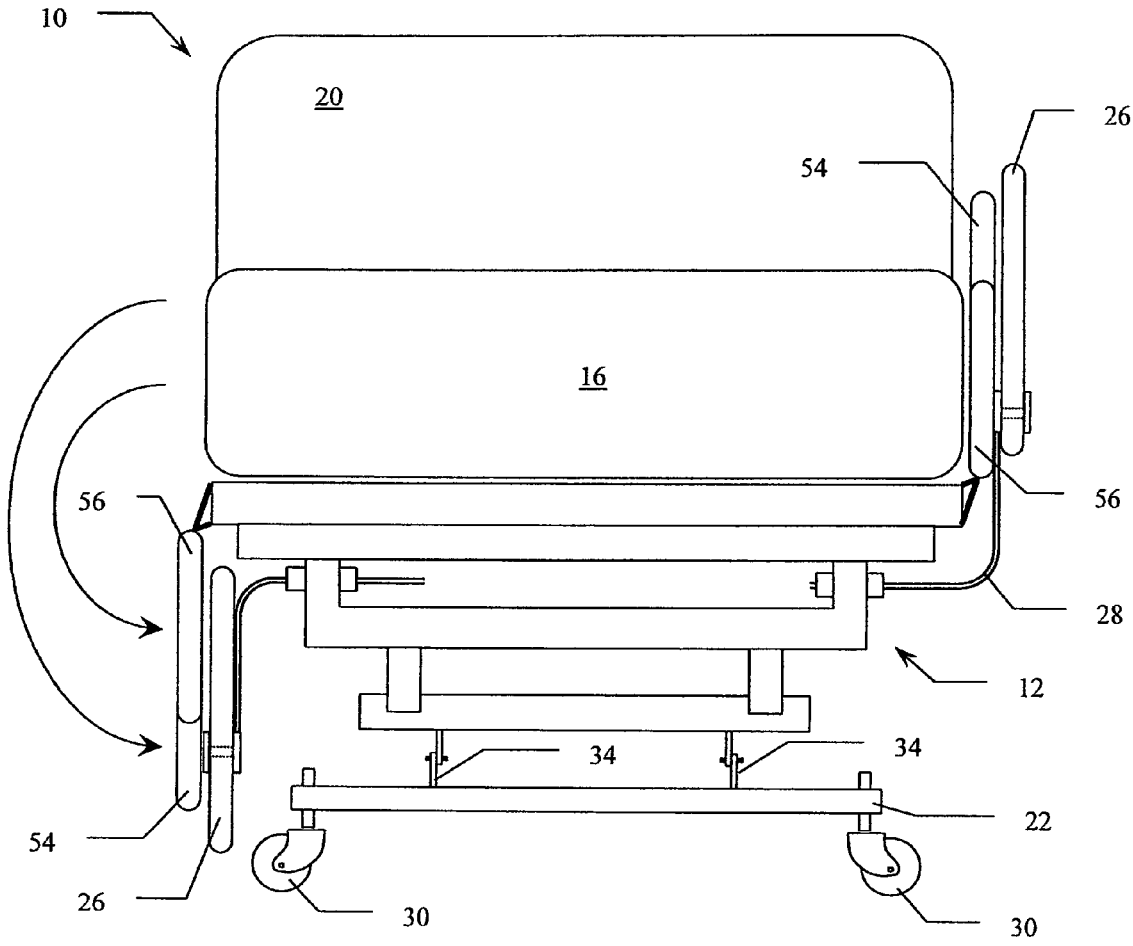
FIG. 8 is a detailed cross-sectional view of a typical patient support system incorporating the side rail pad system of the present invention.

Reference is finally made to FIG. 8 for a brief description of the functional movement of the side rail pads of the present invention during the movement of the side rails up and down on the typical hospital bed structure. FIG. 8 may generally be described as a cross-sectional view through the middle of a patient support system incorporating the side rail pad system of the present invention. In this view, one set of side rails are elevated (on the right side of the view), while a second set of side rails are lowered (on the left side of the view). Lower side rail 26, shown on the right hand side of the FIG. 7 view, is elevated and therefore positions and retains the component side rail pads in place as shown between the elevated side rail 26 and mattress 16. Seen in this cross-sectional view are lower side rail pad 56 and the upper section of middle side rail pad 54. It should be noted that these side rail pads generally fill the space between mattress 16 and side rail 26.

On an opposite side of the bed shown in FIG. 7, side rail 26 has been lowered as is typically accomplished to provide access to the bed by the patient. Exhibited in FIG. 7 is the manner in which side rail pads 54 and 56 fall (by gravity) from their elevated position adjacent mattress 16 to a lowered position against the lowered side rail 26. In this manner, the side rail pad assembly of the present invention, although positioned as needed when the side rails are elevated, falls out of the way so as to not obstruct the entry of the patient into the bed, or the exit of the patient from the bed. The flexible hinges associated with each of the side rail pads serve to allow this pivoting rotation of the pads away from the bed to provide the access as described above. Such flexible hinges may be appropriately configured flexible nylon webbing that incorporate Velcro.RTM. type attachment means for securing the flexible hinge to frame 12. Extended portions of the woven fabric material forming the hinge may serve to allow appropriate positioning of the side rail panels, both in their elevated configuration, and in their lowered configuration. Alternately, the flexible hinges may be rigidly attached to frame 12 by means of attachment screws and/or plates sufficient to secure the flexible material of the hinge directly to the rigid bed frame components. In either case, the objective is to make the side rail pad system capable of being retrofit to existing bed frame structures by adapting to differences in the available attachment points.

Reference is made once again to FIG. 2 for a brief description of the improved profile configurations for each of the side rails in the present invention. As described above, the general configuration of the side rails is determined in part by their motion during the articulation movements of the bed frame. The edge of each side rail defining the space between the two side rails is generally curved to accommodate the translational motion experienced between the two rails upon articulation of the bed. Experience with some current configuration profiles shows that an initially narrow gap between the side rails may expand into a more significant gap (at an intermediate point in the articulation motion) before it again closes with the final articulation movement of the bed frame components.

In an effort to address some of the problems associated with certain of the previous side rail designs, lower side rail 26 shown in FIG. 2 incorporates an extended forward "nose" section that, while still permitting the movement of upper side rail 24 past it during articulation motion, provides increased coverage for the gap between the two side rail components. A similar expansion of the inward facing edge of upper side rail 24 decreases the gap between the side rail components at a number of points in the articulation curve experienced by the side rail components as the bed frame moves. These modified profiles of the side rails may be implemented either by replacement of the side rail panels on existing beds or by the attachment of extension covers to the existing side rail panels. In either case, these modifications may operate in conjunction with the side rail pad system of the present invention to facilitate the occlusion of the spaces and gaps that may exist and form between the split side rails and between the side rails and the mattress.

Although the present invention has been described in terms of the foregoing preferred embodiments, this description has been provided by way of explanation only, and is not intended to be construed as a limitation of the invention. Those skilled in the art will recognize modifications of the present invention that might accommodate specific existing patient support structures or hospital bed configurations. Such modifications as to size, and even configuration, where such modifications are merely coincidental to existing structures of the bed, do not depart from the spirit and scope of the invention which is further defined by the following claims.

I claim:

1. A side rail pad system for use in conjunction with a patient support system, the patient support system having a generally rectangular support platform and a plurality of side rails, the side rails moveable between raised positions adjacent long sides of the support platform and lowered positions away from the long sides of the support platform, the side rail pad system comprising:

a plurality of side rail pads hingedly positioned on a frame component of the patient support system, adjacent the side rails and moveable between raised positions adjacent the long sides of the support platform between the side rails and the support platform, and lowered positions away from the long sides of the support platform, wherein:

said plurality of side rail pads each comprise a generally planar pad having a thickness, said thickness of said side rail pads serving to generally fill a space between the side rails and the support platform when the side rails are in the raised position;

said plurality of side rail pads each comprise a rigid planar form covered on at least one side thereof by at least one soft flexible planar form, said rigid planar form serving to facilitate the maintenance of the shape of the side rail pad; and said rigid planar form of each of said plurality of side rail pads extends generally to just inside the edge of the pad on all sides except a top edge of the pad when the pad is in a raised position and said at least one soft flexible planar form of each of said plurality of side rail pads extends generally to the edge of the pad on all sides, thereby providing a portion of the pad along the top edge thereof that is flexible where contact with a patient on the support surface might occur.

2. The side rail pad system of claim 1 wherein the plurality of side rails comprises a first split pair of side rails adjacent a first long side of the support platform and a second split pair of side rails adjacent a second, opposing long side of the support platform, and said plurality of side rail pads comprises at least one side rail pad positioned at a point generally between the first split pair of side rails and covering at least in part a gap there between, and at least one side rail pad positioned at a point generally between the second split pair of side rails and covering at least in part a gap there between.

3. The side rail pad system of claim 1 wherein said patient support system comprises an articulating system and said plurality of side rails are configured to accommodate the articulating configurations of the patient support system, and wherein said plurality of side rail pads comprise at least one side rail pad having a flexural line allowing the pad to bend in conjunction with the articulating motion and configuration of the patient support system.

4. The side rail pad system of claim 3 wherein said at least one side rail pad having a flexural line allowing the pad to bend in conjunction with the articulating motion and configuration of the patient support system comprises at least two rigid co-planar forms covered on at least one side thereof by a soft flexible planar form, said rigid co-planar forms serving to facilitate the maintenance of the shape of the side rail pad and to define the flexural line of said side rail pad.

5. The side rail system of claim 1 wherein the side rails have one or more apertures for access to a patient on the support platform and wherein said side rail pads are configured to avoid covering the apertures when the side rails and said side rail pads are in a raised position.

6. The side rail system of claim 1 wherein said plurality of side rail pads each further comprise at least one flexible hinge strap positioned on an edge of said pad and further positioned to wrap around a portion of the frame component of the patient support system and to be removably secured back on itself to maintain the side rail pad hingedly positioned on the frame component.

7. The side rail pad system of claim 1 wherein said plurality of side rail pads each further comprise a fabric envelope removably enveloping said rigid planar form and said at least one flexible planar form, wherein said fabric envelope may be removed and washed.

8. A side rail pad system for use in conjunction with a patient support system, the patient support system having three articulating sections forming a generally rectangular support platform and first and second split pairs of side rails, said split pairs of side rails each moveable between raised positions adjacent the long sides of the support platform and lowered positions away from the long sides of the support platform, the side rail pad system comprising:

a first pair of side rail pads hingedly positioned on a frame component of the patient support system associated with a head section of the articulating support system, adjacent the side rails and moveable between raised positions adjacent the long sides of the support platform between the side rails and the support platform, and lowered positions away from the long sides of the support platform;

a second pair of side rail pads hingedly positioned on a frame component of the patient support system associated with a foot section of the articulating support system, adjacent the side rails and movable between raised positions adjacent the long sides of the support platform between the side rails and the support platform, and lowered positions away from the long sides of the support platform; and a third pair of side rails hingedly positioned on a frame component of the patient support system associated with a middle section of the articulating support system, adjacent a gap within the split pairs of side rails and movable between raised positions adjacent the long sides of the support platform between the side rails and the support platform, and lowered positions away from the long sides of the support platform.

9. The side rail pad system of claim 8 wherein each of said side rail pads further comprise at least two flexible hinge straps positioned on an edge of said pad and further positioned to wrap around a portion of the frame component of the patient support system and to be removably secured back on itself to maintain the side rail pad hingedly positioned on the frame component.

10. The side rail pad system of claim 9 wherein said hinge straps each further comprise hook and loop fastener surfaces for removably securing the strap back on itself after being wrapped around a portion of the frame component.

11. The side rail pad system of claim 8 wherein said side rail pads may be retrofit into position on an existing patient support system having moveable side rails without alteration of the structure of the moveable side rails.

12. The side rail pad system of claim 8 wherein said third pair of side rail pads each comprise a pad configured to extend to cover at least in part the gap within the split pairs of side rails, both when the patient support system is in a flat configuration and in an articulated configuration.

13. The side rail pad system of claim 8 wherein said first pair of side rail pads each comprise at least two rigid co-planar forms covered on at least one side thereof by a soft flexible planar form, said rigid co-planar forms serving to facilitate the maintenance of the shape of the side rail pad and to define a flexural line in said side rail pad allowing the pad to bend in conjunction with the articulating motion and configuration of the patient support system.

14. The side rail pad system of claim 8 wherein said second pair of side rail pads each comprise a generally trapezoidal form having a base edge generally longer than a top edge, the resultant sloped side edge serving in part to facilitate the directed movement of the side rail pad into the raised positioned by the same movement of the side rail into a raised position.

15. The side rail pad system of claim 8 wherein said side rail pads may be retrofit into position on an existing patient support system having movable side rails after modification of the movable side rails serves to decrease the existing space between the split side rails and between the side rails and a plurality of additional side enclosure components of the patient support system.

* * * * *